US005159232A

United States Patent [19]

Sato et al.

[11] Patent Number: 5,159,232

[45] Date of Patent: * Oct. 27, 1992

[54] SPARK PLUGS FOR INTERNAL-COMBUSTION ENGINES

[75] Inventors: Yasuyuki Sato; Hiroyuki Murai, both of Aichi; Kozo Takamura, Nagoya, all of Japan

[73] Assignee: Nippondenso Co., Ltd., Kariya City, Japan

[ * ] Notice: The portion of the term of this patent subsequent to Jul. 4, 2006 has been disclaimed.

[21] Appl. No.: 423,147

[22] Filed: Oct. 19, 1989

Related U.S. Application Data

[63] Continuation-in-part of Ser. No. 368,763, Jun. 20, 1989, abandoned, which is a continuation of Ser. No. 182,154, Apr. 15, 1988, Pat. No. 4,845,400.

[30] Foreign Application Priority Data

Dec. 16, 1987 [JP] Japan ..... 62-94053
Dec. 29, 1988 [JP] Japan ..... 63-332010

[51] Int. Cl.[5] ..... H01T 13/22
[52] U.S. Cl. ..... 313/141; 313/142
[58] Field of Search ..... 313/141, 142, 143

[56] References Cited

U.S. PATENT DOCUMENTS 3,313,972 4/1967 Beesch ..... 313/140
4,700,103 10/1987 Yamaguchi et al. ..... 313/141
4,845,400 7/1989 Takamura et al. ..... 313/142

*Primary Examiner*—Sandra L. O'Shea
*Attorney, Agent, or Firm*—Cushman, Darby & Cushman

[57] ABSTRACT

A spark plug for an automotive internal combustion engine providing improved ignition even when carbon is deposited on the insulator of the plug. A rich fuel-air ratio causes carbon to be deposited on spark plug insulators, thereby decreasing its effective insulation. By limiting the geometrical dimension of the plug's center electrode the problem of carbon build-up is overcome. The sizes of these elements have certain allowable ranges that enhance the igniting effect of the plug.

14 Claims, 24 Drawing Sheets

SPARK PLUGS FOR INTERNAL-COMBUSTION ENGINES

This is a continuation-in-part of U.S. application Ser. No. 07/368,763 abandoned and now continued as 07/605,001, which is a continuation of application Ser. No. 07/182,154 now U.S. Pat. No. 4,845,400.

BACKGROUND OF THE INVENTION

1. Industrial Field of Utilization

The present invention relates to spark plugs to be used in internal-combustion engines for automobiles.

2. Description of the related Art

In conventional gasoline internal-combustion engines for automobiles, a method for supplying a very rich air-fuel mixture into combustion chambers has been used as one means for ensuring specified engine operation performance at low temperatures. This method, however, has the side effect of producing much carbon in the combustion chamber, due to the incomplete combustion of the air-fuel mixture. This carbon is gradually deposited on the surface of an insulator of the spark plug installed in the combustion chamber. Such a spark plug covered with carbon residue has a tendency that the high voltage supplied from an ignition coil leaks through the carbon residue on the insulator, resulting in sporadic sparks jumping across the spark-plug gap and accordingly increased combustion misses and misfiring of the air-fuel mixture in the combustion the combustion chamber. Particularly in a four-wheeled automobile equipped with batteries for ignition, unlike the capacitor-discharge ignition (CDI) system which improves leakage characteristics as seen in a two-wheeled motor vehicle, a problem is likely to occur in connection with the deposits of soot and carbon residue.

To solve this problem, a special spark plug for internal-combustion engines is disclosed in Japanese Patent Publication No. 58-40831. This spark plug is designed such that a spark jumps across a first spark-plug gap under a normal operating condition when no carbon residue is present over the end of the insulator nose and the inside bore wall surface are stained with soot and carbon deposits. This spark reaching the second gap burns off carbon deposits covering the inside bore wall surface, recovering the normal surface condition for sparking.

However, since the second gap of the above-described conventional spark plug for the internal-combustion chamber is provided on the wall surface side of the combustion chamber relative to the first gap, the core of flame produced by a spark across the second gap can not easily contact the mixture. In addition the second gap is smaller in size than the first gap, and therefore the flame core can not grow larger. Consequently, there occurs the problem that a spark generated across the second gap results in unreliable ignition of the air-fuel mixture.

For the purpose of solving this problem, spark plugs for internal-combustion engines have previously been proposed by the present inventor et al in Japanese Patent Application No. 63-83369 (filed Apr. 5th, 1988).

This spark plug for the internal-engine is designed to ionize the ambient atmosphere by capacity discharge, and to burn off carbon deposits in the inside bore of the insulator by utilizing induction discharge generated within the most ionized area of the range of ionization. In this spark plug for the internal-combustion engine, because the small-diameter portion of the center electrode projects out of the inside bore of the insulator over the end of the insulator nose a larger flame core can be produced by the gap, thereby enabling an improvement in the ignition of the air-fuel mixture.

The automotive industry will be more and more demanded in future to build automobiles of higher performance and accordingly will require component parts of better quality. Since spark plugs for internal-combustion engines in particular directly determine the engine operation performance, it can well be expected that much stricter requirements will be imposed for the manufacture of spark plugs having an improved carbon burn-off effect.

It is, therefore, an object of this invention to provide spark plugs for the internal-combustion engine which are able to remarkably improve the ignition of the air-fuel mixture and the carbon burn-off effect to remove carbon deposits from the insulator.

DETAILED DESCRIPTION OF THE INVENTION

Figure 3:
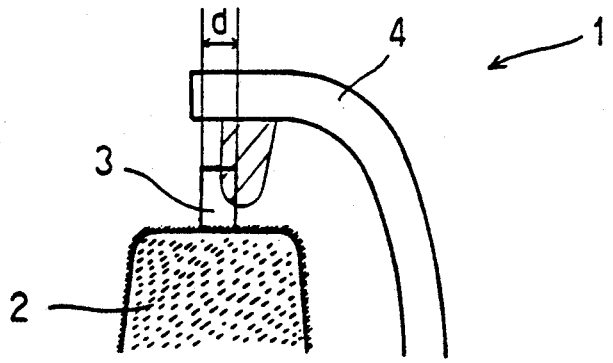
FIG. 3 is a schematic diagram showing a side discharge across a spark-plug gap.

Spark discharge produced across the electrode gap of a spark plug 1 may be divided into two types: capacitive discharge which breaks insulation between the electrodes and induction discharge which subsequently takes place along the range of lowered insulation through the ionization cf the ambient atmosphere. FIG. 3 is a schematic diagram for observing the state of the spark plug used in an air-cooled, four cycle, 230 cc single-cylinder engine running at the speed of 1500 rpm at idle in which a crystal was embedded in a part where the spark plug discharge could be observed. In this drawing, the state of the spark plug producing the inductive discharge is shown, partly enclosed by oblique lines indicating the induction discharge.

As a result of research performed in an attempt to accomplish the above-mentioned object, the present inventor et al found that, in the case of the capacity discharge, a spark plug with a center electrode 3 of an extremely small diameter d, much smaller than ordinary types, produced a spark at the end of the center electrode 3 as in normal diameter size plugs and that, in the case of the induction discharge, the spark jumped from at the side of the end area of the center electrode 3. The present inventor et al, therefore, noticed the reliable and remarkable burn-off of carbon deposits from the insulator of the spark plug by utilizing the induction discharge generated at the side of the end area of the center electrode 3.

The spark plug 1 for the internal-combustion engine includes a cylindrical insulator 2 having an inside bore 23 in the axial direction; a center electrode 3 inserted in the inside bore and held in the insulator 2 with its end projecting out of the inside bore 23; a ground electrode 4 forming a gap between the same and the end of the center electrode 3; and a housing holding the ground electrode 4, and fixed on the outer periphery of the insulator 2. In this spark plug 1, a cylindrical space 6 opening at the insulator nose between the outer periphery of the center electrode 3 and the inner wall of the inside bore 23.

This spark plug 1 satisfies the following relations:

$$0.60\ \text{mm} \leqq d \leqq 1.55\ \text{mm},$$

$$0.2\ \text{mm} \leqq l \leqq 1.1\ \text{mm},$$

$$D \leqq 1.1d\ \text{mm} + (l/2)\text{mm} + 0.2\ \text{mm}$$

$$D \leqq 0.9d\ \text{mm} - (l/2)\text{mm} + 1.6\ \text{mm}$$

where 1 denotes the length of the center electrode 3 projecting out of the cylindrical space 6, d represents the diameter of the center electrode 3 projecting out of the cylindrical space 6, and D is the inner diameter of the inside bore 23 forming the cylindrical space 6 between the inside bore and the center electrode 3.

The center electrode 3 projecting out of the cylindrical space 6 has a tapered portion at the end; d indicates the largest diameter at the tapered portion of the center electrode 3.

Figure 4:
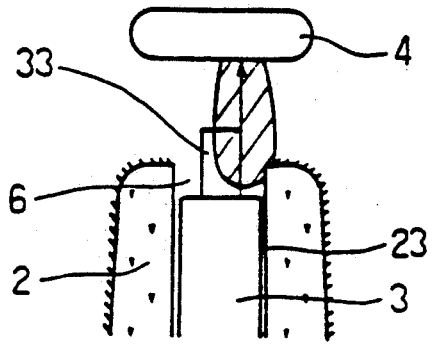
FIGS. 4 to 10 are explanatory views showing the operation of the spark plug of this invention.

The inventor et al of this invention have found the following effects of the spark plug 1, which will be explained with reference to FIGS. 4 to 11. FIG. 4 shows a spark plug 1 slightly covered with carbon residue, with which the capacity discharge and induction discharge take place. FIGS. 5 to 9 snow the lapse of discharge time and principal cleaning mechanism in the spark plug 1 heavily covered with carbon deposits. FIG. 10 shows the state of the spark plug 1 after the finish of the first discharge.

Figure 9:
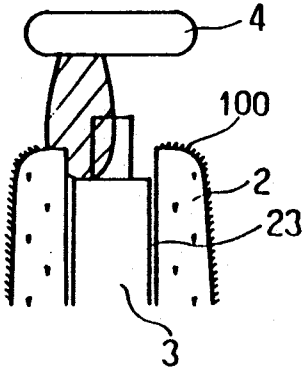
Figure 10:
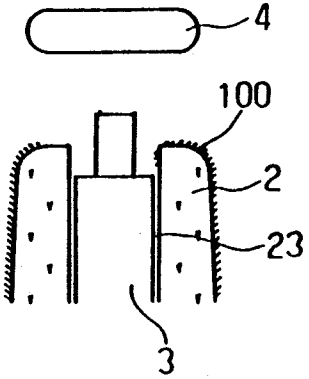
Figure 11:
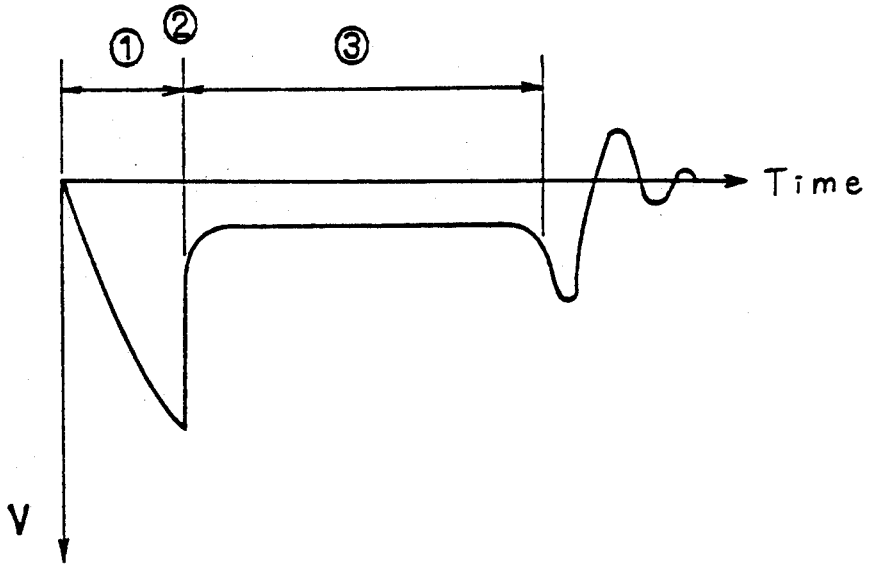
FIG. 11 is a waveform chart showing the waveform of capacity discharge and induction discharge.

In FIGS. 4 to 10, a full line with an arrow indicates the capacity discharge; and area enclosed with oblique lines is the induction discharge; a waveform area is a pilot discharge which accelerates the cleaning action; and a dotted area represents an ionized area. FIG. 4 to 10 are schematic diagrams for the observation of the capacity discharge and the induction discharge in an internal-combustion engine using spark plugs with a crystal glass embedded in a part where spark plug discharge can be observed, and an analysis of a result of the observation. FIG. 11 is a schematic diagram of the capacity discharge and induction discharge waveforms.

The spark plug 1 is likely to be covered with carbon 100 over the nose of the insulator 2 and the wall surface of the inside bore 23 when very rich air-fuel mixture is used.

As shown in FIG. 4, in the insulator 2 slightly covered with carbon 100 residue, a capacity discharge is generated from the edge of the center electrode 3 when a high voltage is applied to the center electrode 3. At this time, the induction discharge is generated in the ionization range of ambient atmosphere which has been ionized by the capacity discharge. Since the capacity discharge takes place across the electrode gap formed between the end of the center electrode 3 and the ground electrode 4, the induction discharge also is generally thought to be generated across this gap, but the ionization range presented by the capacity discharge spreads as far as the area in which the side of the center electrode 3 also can be ionized. At this time the induction discharge is occurring from the side of the center electrode 3 into the gap, thereby burning off carbon 100 deposits from the insulator exposed to the induction discharge (hereinafter referred to as the side discharge).

The foregoing description relates to a spark plug 1 slightly covered with carbon 100. Depending upon engine operating conditions, however, it is probable that the spark plug 1 will be covered with excessively thick carbon 100. In this case, carbon 100 residue will cover nearly the whole surface of the insulator 2 and the inner wall of the inside bore 23, resulting in decreased insulator 2 resistance between the center electrode 3 and the housing 5.

Figure 5:
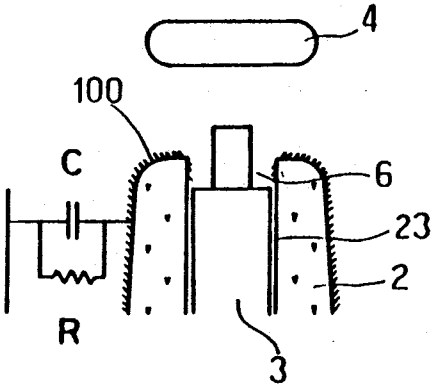

FIG. 5 is a schematic diagram showing the condition in which the electrostatic capacity C and the leakage resistance R are applied in parallel between the insulator 2 surface and the housing due to the presence of a high-resistance conductive layer carbon. With the application of the high voltage to the center electrode 3, the leakage current flows from the center electrode 3 to the housing 5 through the leakage resistance on the insulator surface 2, and also a charge current flows to charge between the center electrode 3 and the inner wall of the inside bore 23 and between the insulator 2 surface and the housing 5.

Figure 6:
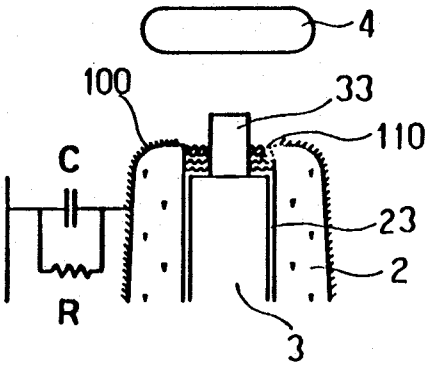

During the rising time (1) when the high voltage shown in FIG. 11 gradually increases, the current for charging the electrostatic capacity flows between the wall surface of the inside bore 23 of the insulator 2 and the side of the small-diameter portion 23 of the center electrode 3, and also the leakage 110 current flows to the leakage resistance from a stepped edge portion of the center electrode 3 as a starting point. FIG. 6, therefore, indicates that the cylindrical space 6 is ionized by these currents.

It has newly been found that this phenomenon has the same function as the so-called pilot discharge generated at three-core gap. Carbon deposited on the working end of the spark plug is equivalent to the third electrode of this three-core gap spark plug.

A technological idea of the ionization of the cylindrical space 6 is based on the action of the third electrode at the three-core gap, that is, the pilot discharge that accelerates ionization in the gap. In this invention, the cylindrical space 6 is provided to facilitate ionization by utilizing carbon residue which a gradually deposited, as the third electrode.

Figure 7:
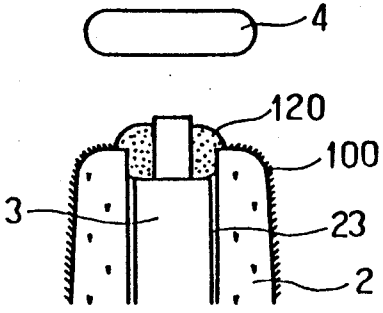

This action is continuously effected during a period of time when the voltage being applied reaches a voltage great enough to generate the capacity discharge to break insulation at the gap shown at (2) of FIG. 11, keeping on the expansion of the ionization range 120 in the vicinity of the cylindrical space 6 as shown in FIG. 7.

Figure 8:
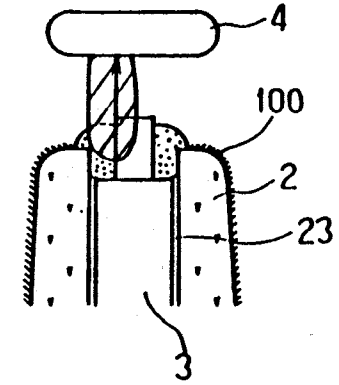

The capacity discharge takes place across the gap from the end of the center electrode 3 as shown in FIG. 8 the instant the voltage applied has reached a value at which there occurs the capacity discharge which breaks insulation at the electrode gap shown at (2) of FIG. 11. At this time, as described above, as the ionization range by the capacity discharge has spread wide enough to include the side of the center electrode 3 within the ionization range, and therefore the side discharge will occur into the gap from the side of the center electrode 3 immediately after the generation of the capacity discharge, thereby burning off carbon 100 deposits from the insulator portion exposed to the side discharge.

Furthermore, with the combination of the ionization region produced in the gap by this side discharge with the ionization region produced in the cylindrical space 6 by the aforesaid pilot discharge, the side discharge blows out into the gap from a wide area including the cylindrical space 6 and the end and side surfaces of the center electrode 3 as shown in FIG. 9. This side discharge continues during the continuous discharge time (3) shown in FIG. 11. Accordingly the carbon deposits on the wall surface of the inside bore forming the cylindrical space 6 between the inside bore 23 and the outer periphery of the center electrode 3 and on the nose of the insulator 2 can be burned off.

After the lapse of the continuous discharge time (3) shown in FIG. 11, one discharge cycle will end. At this time, as shown in FIG. 10, the wall surface of the inside bore 23 exposed to the side discharge and the insulator nose are cleaned after the burn-off of carbon deposits.

At the subsequent discharges cycles, the pilot discharge occurs and the side discharge shown in FIG. 9 is produced in other areas such as soft in FIG. 10 covered with carbon 100 residue of the inner wall of the inside bore of the insulator than the cleaned portion, thus gradually burning off the carbon 100 residue on the wall surface of the inside bore 23 and the insulator nose.

That is, in the spark plug of this invention the burn-off of carbon deposits of the insulator 2 can be effected by two kinds of discharges: the side discharge alone and the side discharge combined with the ionization range produced by the pilot discharge.

Figure 1:
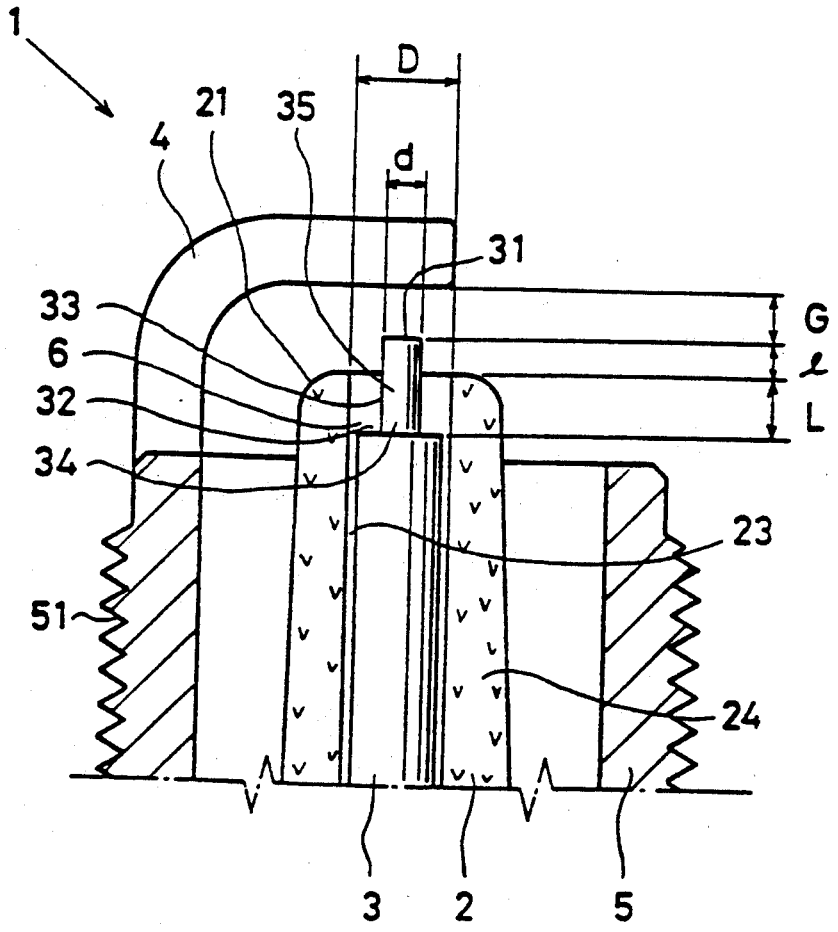
FIG. 1 is a sectional view showing a spark plug for internal-combustion engines according to one embodiment of this invention.
Figure 2:
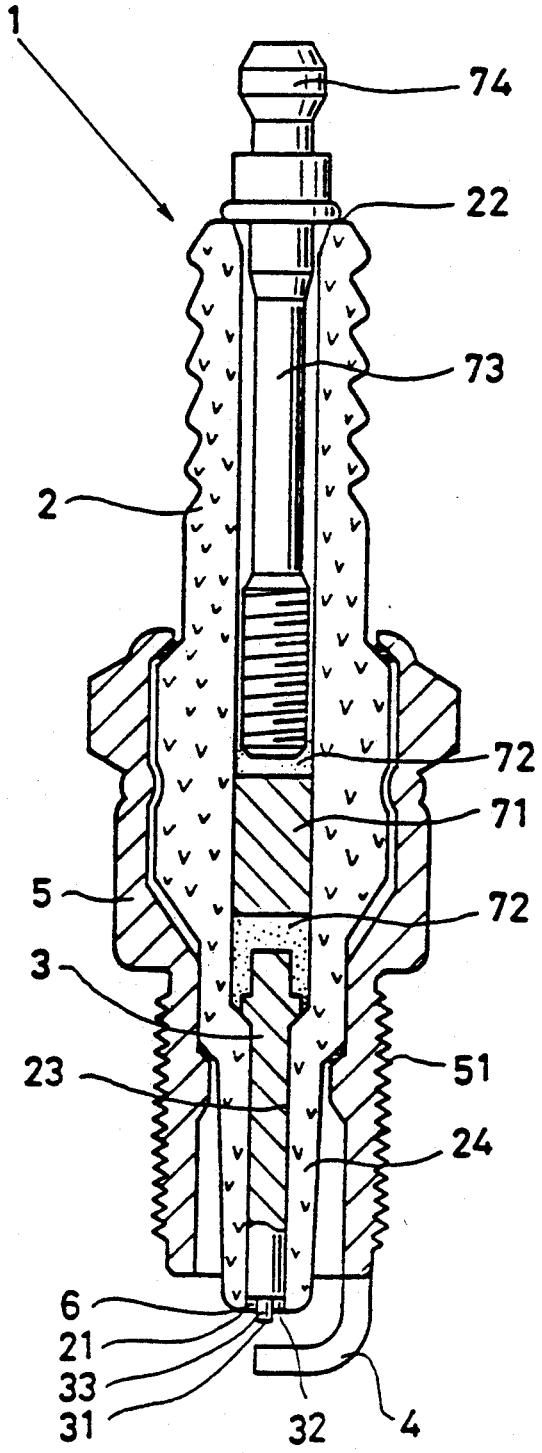
FIG. 2 is a sectional view showing a major portion of the spark plug for internal-combustion engines according to the embodiment of this invention.

FIG. 1 shows a major portion of the spark plug for internal-combustion engines according to this invention, and FIG. 2 shows a spark plug for internal-combustion engines adopting this invention.

Numeral 1 denotes the spark plug for internal-combustion engines.

The spark plug 1 has a cylindrical insulator 2, a center electrode 3 held in the insulator 2, a ground electrode 4 forming a gap G between the same and the tip face 31 of the center electrode 3, and a metallic housing 5 holding the ground electrode 4.

The insulator 2 has an axial inside bore 23 opening at the top end 21 and the bottom end 22. The center electrode 3 is inserted, in the inside bore 23 of a nose section 24 of this insulator 2 which projects into the combustion chamber of the internal-combustion engine.

The center electrode 3 is inserted in the inside bore 23 with its tip face 31 projecting out of the inside bore 23 and held in the nose 24 of the insulator 2.

The top end portion above the edge section 32 of this center electrode 3 is a small-diameter portion 33 which is smaller in diameter than the inner diameter of the inside bore 23. This small-diameter portion 33 includes an inserted portion 34 positioned within the inside bore 23 and an projecting portion 35 projecting out of the inside bore 23. Between the outer periphery of the inserted portion 34 positioned in the inside bore 23 of the small-diameter portion 33 and the wall surface of the inside bore 23 is formed a cylindrical space 6 opening at the top end 21 of the insulator 2.

The ground electrode 4 is disposed opposite to the tip face 31 of the center electrode 3.

The housing 5 is provided with a screw mounting section 51 on the outer periphery with the ground electrode 4 connected to the end thereof. Also this housing 5 is secured on the outer periphery of the insulator 2.

The spark plug also includes a resistor 71 for the suppression of radio wave noise, numeral 72 indicates an inductive layer of glass 72, a terminal stud 73, a terminal 74.

Various experiments were conducted on the spark plug of FIG. 1 to determine how characteristics changed by varying which represents the length of the center electrode 3 projecting out of the cylindrical space 6, d which represents the diameter of the center electrode 3 projecting out of the cylindrical space 6, D which represents the inner diameter of the inside bore 23 forming the cylindrical space 6 between the inside bore 23 and the center electrode 3, and L which represents the depth of the cylindrical space 6. The result of the experiments will be described hereinafter.

First, an explanation will be made on the side discharge.

As a result of various experiments, the present inventors et al have found that the side discharge is generated when a small-diameter center electrode is adopted.

It has been ascertained that with the generation of the capacity discharge from the tip of the center electrode, the ambient atmosphere around this capacity discharge is ionized, and this ionization range is successively generated by induction discharge.

During this time, in addition, the air-fuel mixture is flowing in the engine combustion chamber. The vicinity of the center electrode itself becomes an obstacle for the flow of the mixture, increasing the turbulent component of the flow. Therefore, it is postulated that the side discharge is generated by the ionization range flowing from the tip of the center electrode.

The present inventor et al, therefore, noticed the burn-off of carbon deposits on the side of the tip of the center electrode through the utilization of this side discharge.

Figure 12:
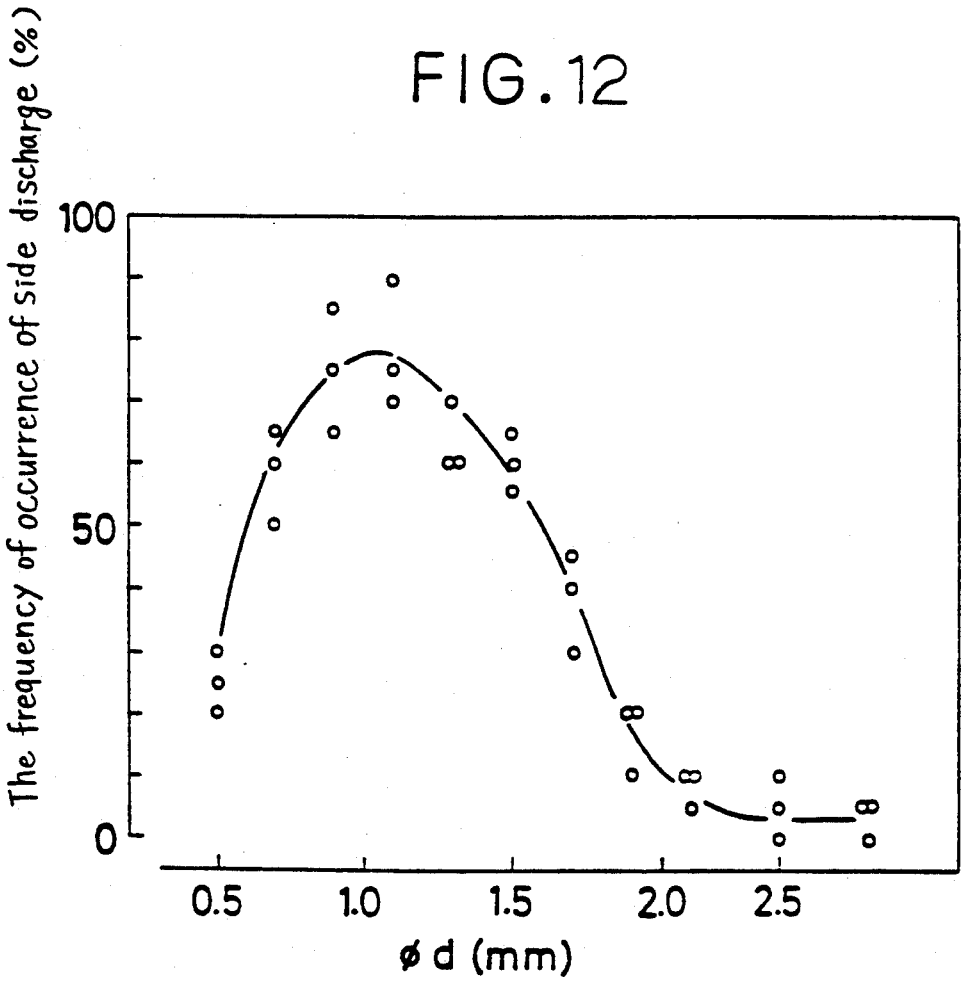
FIG. 12 is a graph showing a relation of the diameter d of the center electrode projecting out of a cylindrical space to the frequency of occurrence of side discharge.
Figure 13:
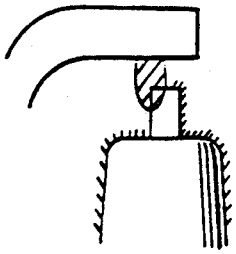
FIG. 13 is an explanatory view showing the side discharge that occurred in experiments conducted in FIG. 12.

FIG. 12 shows the diameter d of center electrode on the horizontal axis and the frequence of generation of the side discharge on the vertical axis. FIG. 13 is a schematic presentation showing the side discharge generated in the experiments conducted in FIG. 12. The side discharge generation frequency, in spark plugs in conventional use, suddenly increases below 2.0 mm when the diameter (d) of the center electrode projecting out of the insulator nose is decreased from 2.5 mm, and begins to increase largely at the diameter (d) of below 1.5 mm.

When the diameter (d) of the center electrode employed is around 2.5 mm, the ionization range becomes hard to flow due to the turbulent component of the flow. From this, it is presumed that the side discharge generation frequency remarkably decreased. The side discharge generation frequency decreases with a decrease in the diameter (d) of the center electrode of the spark plug more than 0.9 mm. This is presumed to be the use of an apparently needle-like extremely thin center electrode, which makes a potential gradient at the tip of the center electrode, which makes very sharp, thereby particularly promoting the ionization at the tip of the center electrode and decreasing the side discharge generation frequency. If the diameter (d) of the center electrode of the spark plug is decreased to 0.5 mm or less, it is probable that the center electrode will be molten or impaired by the energy of the discharge. Therefore center electrodes of less than $d=0.5$ mm are unserviceable.

Figure 14:
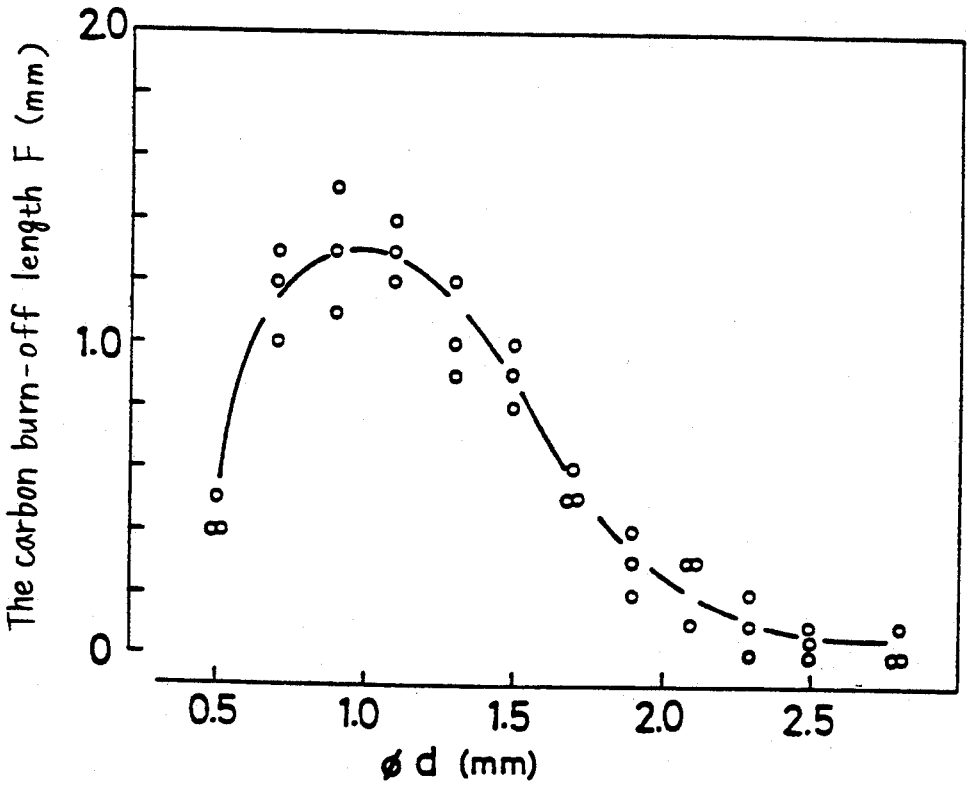
FIG. 14 is a graph showing a relation of the diameter d of the center electrode projecting out of the cylindrical space to the carbon burn-off length F.
Figure 15:
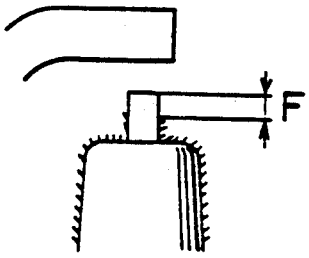
FIG. 15 is an explanatory view showing a spark plug used in performing experiments of FIG. 14, in which F represents the carbon burn-off length.

FIG. 14 shows the diameter d of the center electrode plotted on the horizontal axis and the carbon burn-off length F plotted on the vertical axis. FIG. 15 shows a spark plug used in the experiment performed in FIG. 14, in which F denotes the carbon burn-off length.

According to FIG. 12, the high side discharge generation frequency (over 50 ) is when $0.6\ mm \leqq d \leqq 1.6\ mm$. In the meantime, according to FIG. 14, the long carbon burn-off length F (over 0.8 mm) is when $0.5\ mm \leqq d \leqq 1.55\ mm$. Therefore, a higher side discharge generation frequency and a longer carbon burn-off length F will occur when $0.60\ mm \leqq d \leqq 1.55\ mm$.

The present inventor et al have found that the generation of the side discharge varies with the diameter d of the center electrode, and the carbon burn-off length also varies with the diameter d of the center electrode. It is, therefore, necessary to select the center electrode diameter within a range of high side discharge generation frequency and long carbon burn-off length F, that is, $0.60\ mm \leqq d \leqq 1.55\ mm$ obtained from the result of experiments. Furthermore, since it is $0.8\ mm \leqq d \leqq 1.4\ mm$ at 70% of the side discharge generation frequency and $0.8\ mm \leqq d \leqq 1.2\ mm$ at 1.2 mm of the carbon burn-off length F, the optimum value of the diameter d may be said to be $0.8\ mm \leqq d \leqq 1.2\ mm$.

Subsequently, experiments were conducted on the length (l) of the center electrode.

Figure 16:
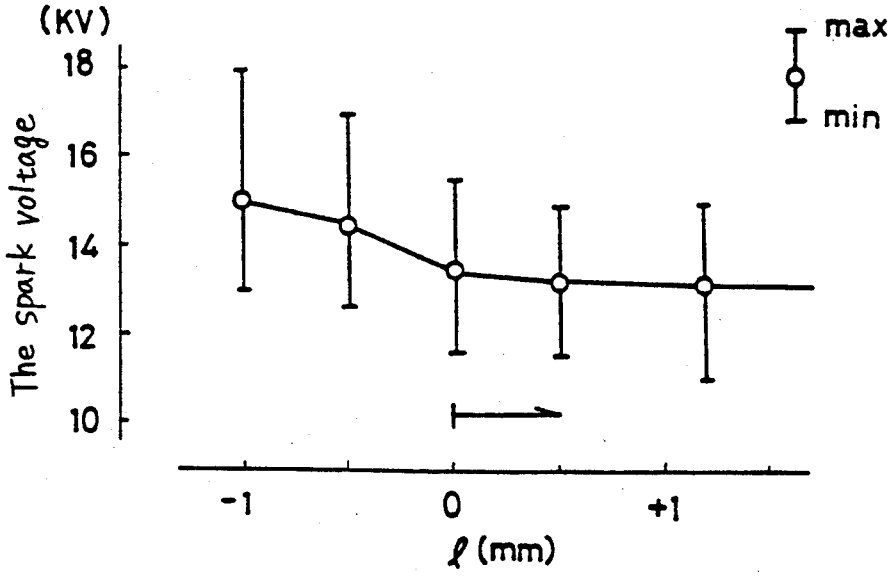
FIG. 16 is a graph showing a relation of the length 1 of the center electrode projecting out of the cylindrical space to the spark voltage between the center and ground electrodes.
Figure 17:
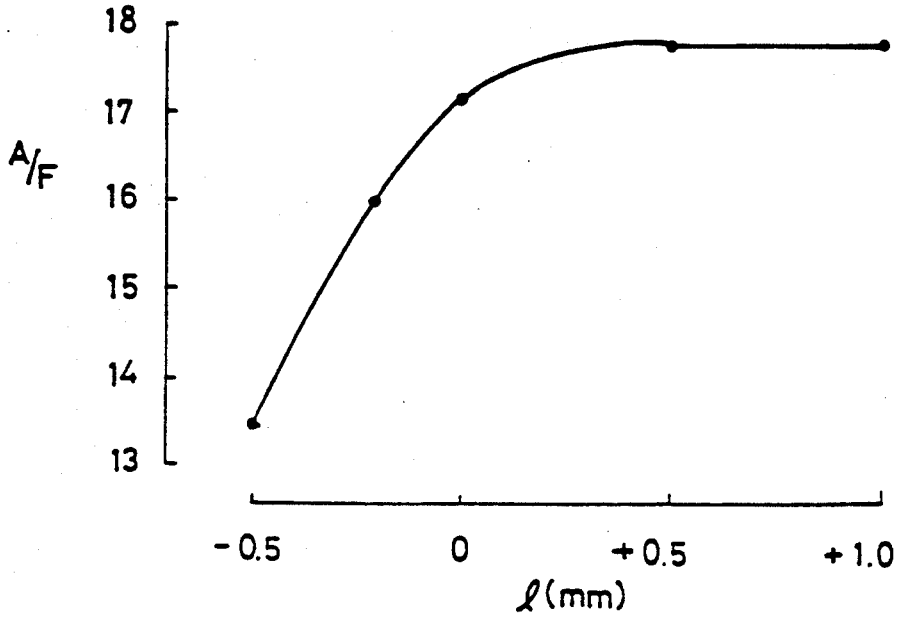
FIG. 17 is a graph showing a relation of the length 1 of the center electrode projecting out of the cylindrical space to the air-fuel ratio within the ignition limit at idle.

FIG. 16 shows the length l of the center electrode plotted on the horizontal axis and the spark voltage between the center electrode and the ground electrode plotted on the vertical axis In the experiments the plug gap G between the tip of the center electrode and the ground electrode in the 4-gauge atmospheric air was set to 1.1 mm. FIG. 17 shows the length l of the center electrode plotted on the horizontal axis and the air-fuel ratio (A/F) at the ignition limit at idle which is an index expressing the ignition performance, plotted on the vertical axis. In these experiments, a four-cycle, 1600 cc, water-cooled four-cylinder engine was used. While this engine was running at idle, the air-fuel mixture was leaned out to provide an air-fuel ratio (ignition limit air-fuel ratio) suitable for the stabilization of combustion. Fizz 18 shows the dimensions of the spark plug used in the experiments in FIG. 16 and 17.

The lower spark voltage than that in FIG. 16 is due to the center electrode length of $0\ mm \leqq l$. From FIG. 17 it could be ascertained that the ignition performance is little affected as long as if the tip of the center electrode projects out of the nose of the insulator.

Figure 18:
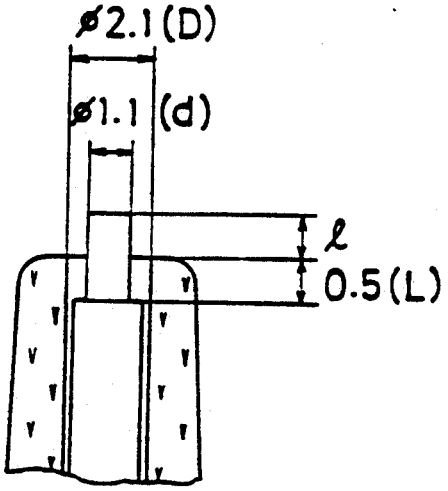
FIG. 18 is an explanatory view showing the dimensions of a spark plug used in conducting the experiments of FIG. 16 and 17.

In FIG. 18 the spark voltage is lower and the ignition performance is less affected than those in FIGS. 16 and 17 because 0 mm≦l. However, the spark plug is subjected to gradual consumption of the tip of the center electrode, thus resulting in a gradually decreased length of the center electrode. This consumption of the tip of the center electrode of this spark plug has been empirically confirmed to reach a maximum 0.2 mm at the end of its service life. Therefore, an optimum length of the center electrode is 0.2 mm≦l to ensure low spark voltage and little influence on the ignition performance until the end of the service life.

Furthermore, experiments were conducted on the effect of resistance to fouling through effective combination of the side discharge of the center electrode and the ionization range in the cylindrical space for the purpose of finding the length of the center electrode, the diameter d of the center electrode, the inside diameter D of the inside bore, and the depth L of the cylindrical space. A result of the experiments thus conducted will be explained below.

Figure 19:
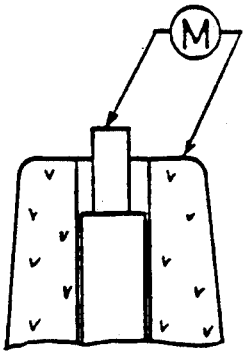
FIG. 19 is an explanatory view showing the measurement of insulation resistance for the evaluation of the effect of resistance to fouling.

In experimenting the effect of resistance to fouling, a four-cycle, 1300 cc, water-cooled four-cylinder engine was run under a condition in which the spark plug is likely to soot up with carbon. Namely, a series of operation patterns of engine starting, racing, acceleration and deceleration at a low speed, and stopping were carried out for one minute at the atmospheric temperature of below −10° C., and at the radiator water temperature and engine oil temperature of below −10° C. This series of operation patterns were evaluated as one cycle. As shown in FIG. 19, insulation resistance between the tip of the center electrode and the tip of the insulator nose was measured by the use of an insulation-resistance tester M to find the number of cycles of the insulation resistance up to 1 MΩ. If the insulation resistance between these two points decreases below 1 MΩ, engine troubles, such as hard starting and rough idling, occur. Spark plugs Type W16EX-$U_{11}$ the applicant manufactured as typical examples of spark plugs most adopted in general, showed an evaluation result of 1 MΩ at eight cycles. Accordingly, it can be clarified that a desired effect can not be obtained under the eight cycles.

Figure 20:
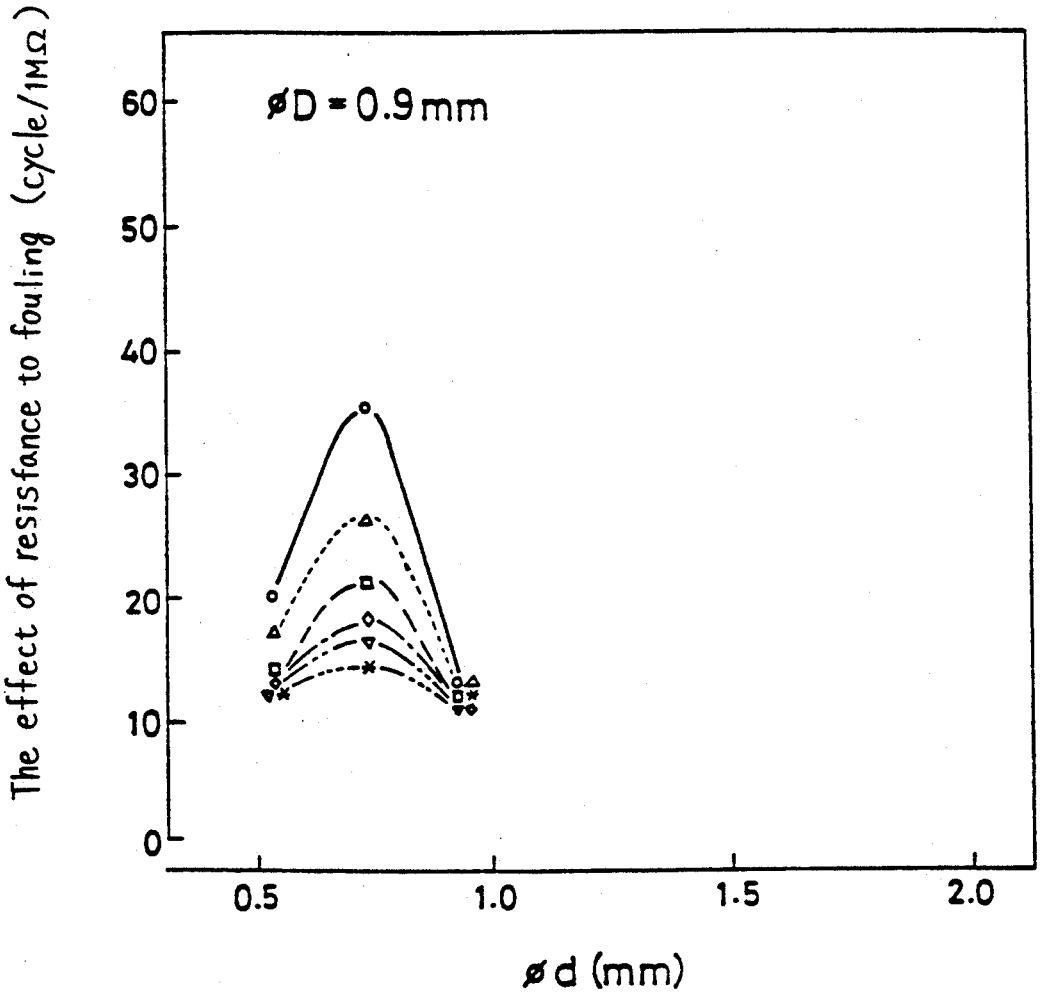
FIG. 20 is a graph showing a relation of the diameter d of the center electrode projecting out of the cylindrical space to the effect of resistance to fouling when the inner diameter of the inside bore forming the cylindrical space between the inside bore and the center electrode is D=0.9 mm.
Figure 21:
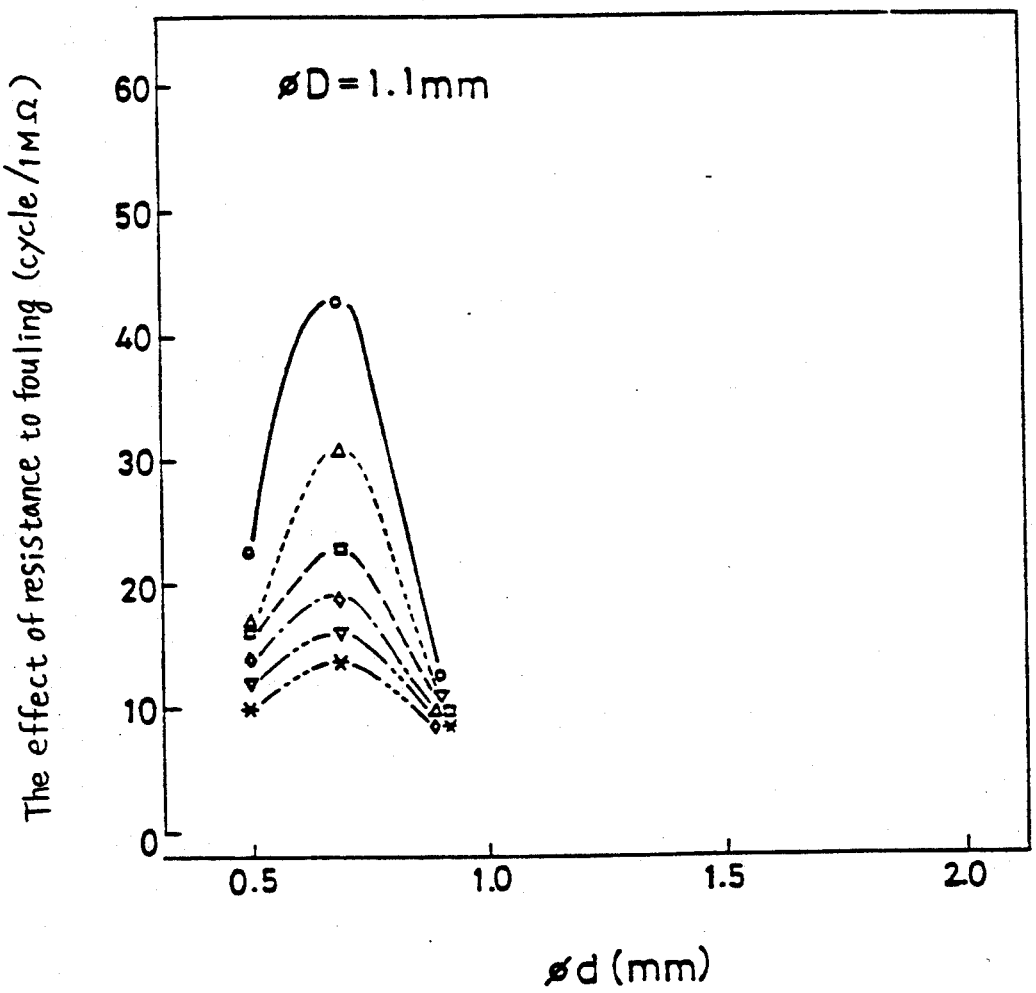
FIG. 21 is a graph showing a relation of the diameter d of the center electrode projecting out of the cylindrical space to the effect of resistance to fouling when the inner diameter of the inside bore forming the cylindrical space between the inside bore and the center electrode is D=1.1 mm.
Figure 22:
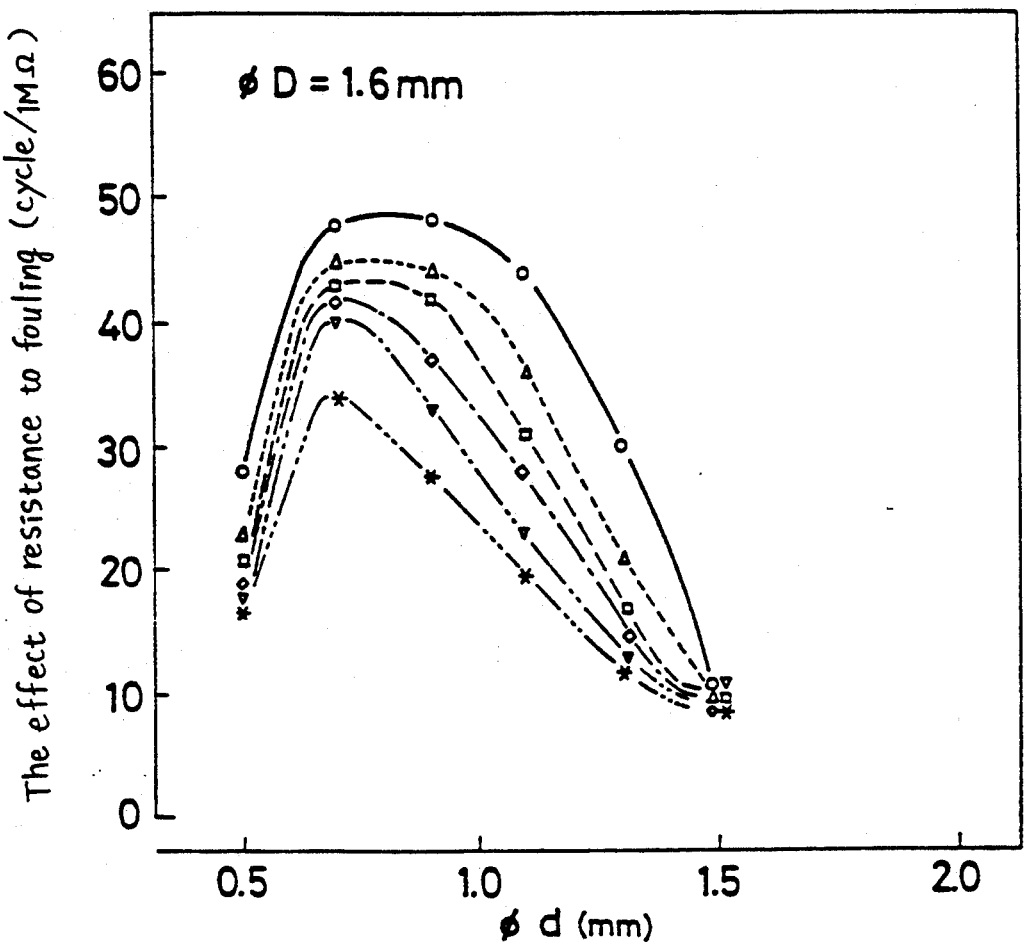
FIG. 22 is a graph showing a relation of the diameter d of the center electrode projecting out of the cylindrical space to the effect of resistance to fouling when the inner diameter of the inside bore forming the cylindrical space between the inside bore and the center electrode is D=1.6 mm.
Figure 23:
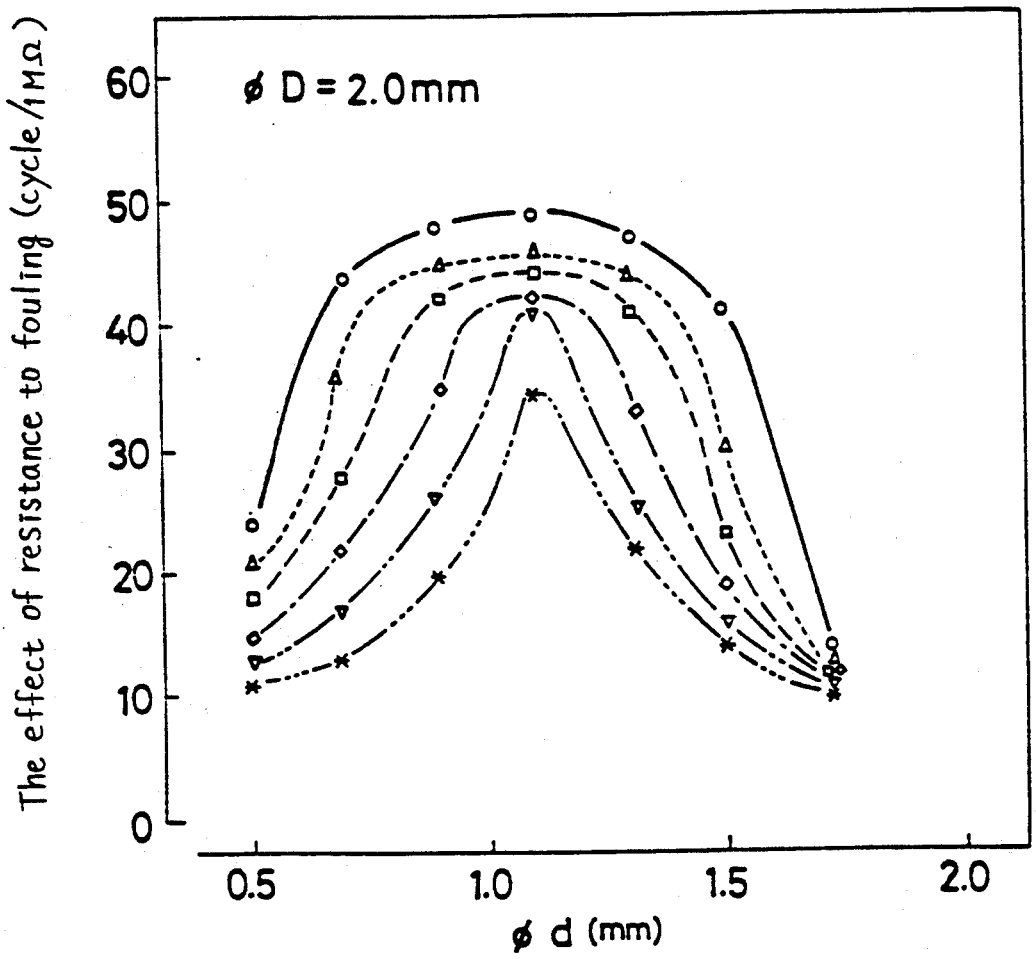
FIG. 23 is a graph showing a relation of the diameter d of the center electrode projecting out of the cylindrical space to the effect of resistance to fouling when the inner diameter of the inside bore forming the cylindrical space between the inside bore and the center electrode is D=2.8 mm.
Figure 24:
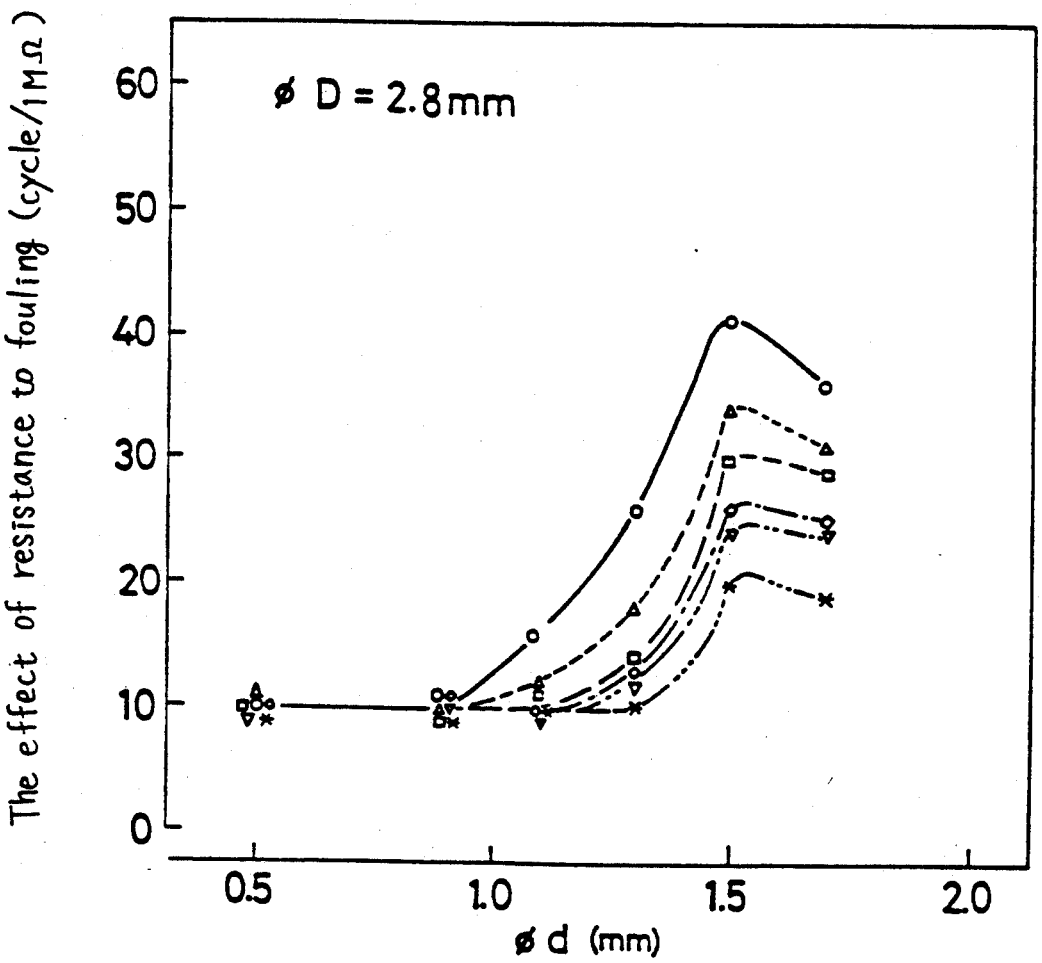
FIG. 24 shows a graph between diameter of the center electrode and the effect of resistance to fouling.
Figure 25:
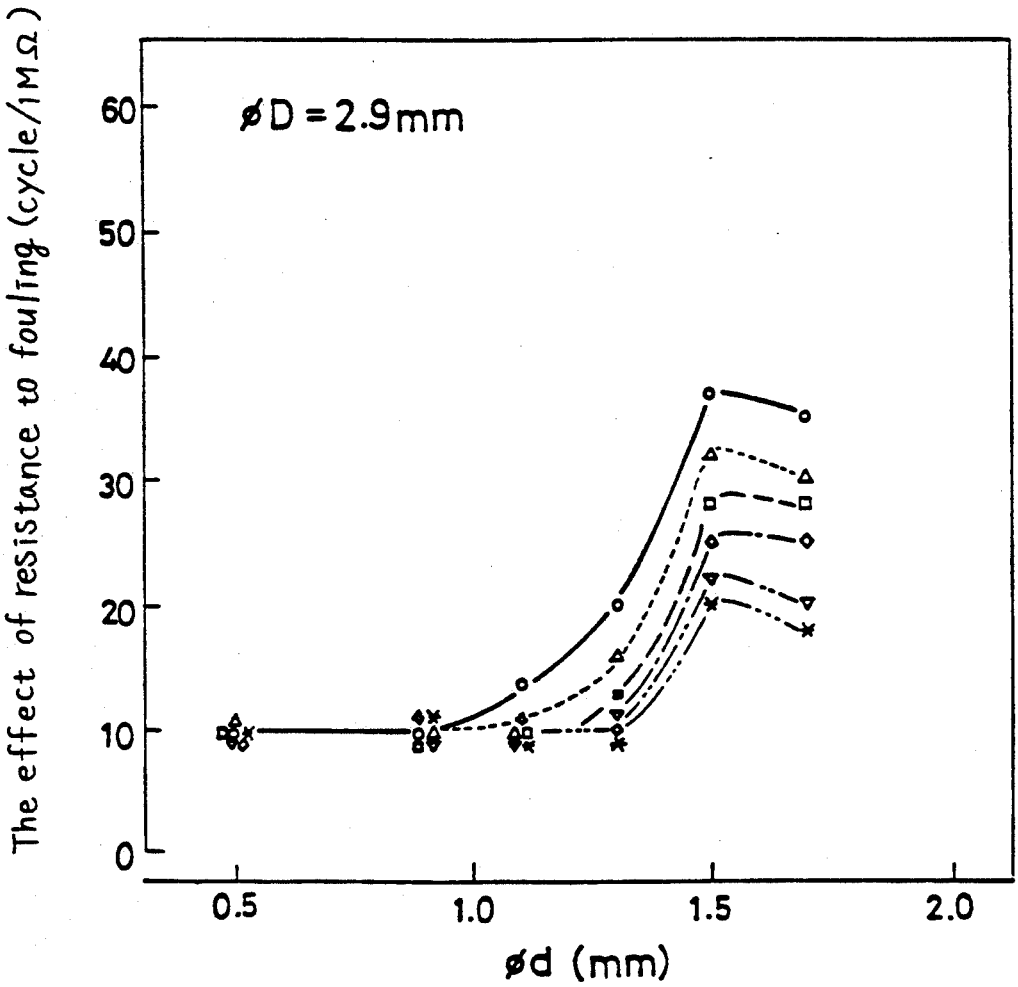
FIG. 25 graph showing a relation of the diameter d of the center electrode projecting out of the cylindrical space to the effect of resistance to fouling when the inner diameter of the inside bore forming the cylindrical space between the inside bore and the center electrode is D-2.9 mm.

FIG. 20 shows the diameter d of the center electrode plotted on the horizontal axis and the effect of resistance to fouling plotted on the vertical axis, when the inner diameter of the inside bore is D=0.9 mm, FIG. 21 shows the diameter d of the center electrode plotted on the horizontal axis and the effect of resistance to fouling plotted on the vertical axis, with the inner diameter of the inside bore being D=1.1 mm. FIG. 22 shows the diameter d of the center electrode plotted on the horizontal axis and the effect of resistance to fouling plotted on the vertical axis, with the inner diameter d of the inside bore being D=1.6 mm. FIG. 23 shows the diameter d of the center electrode plotted on the horizontal axis and the effect of resistance to fouling plotted on the vertical axis, with the inner diameter of the inside bore being D=2.0 mm. FIG. 24 shows the diameter d of the center electrode plotted on the horizontal axis and the effect of resistance to fouling plotted on the vertical axis, with the inner diameter of the inside bore being D=2.8 mm. FIG. 25 shows the diameter d of the center electrode plotted on the horizontal axis and the effect of resistance to fouling plotted on the vertical axis, with the inner diameter of the inside bore being D=2.9 mm. In FIGS. 20 to 25, o denotes the length l=0.2 mm; Δ represents the length l=0.5 mm; □ indicates the length l=0.7 mm; ◇ is the length l=0.9 mm; ▽ is the length l=1.1 mm; and * is the length l=1.2 mm.

Figure 26:
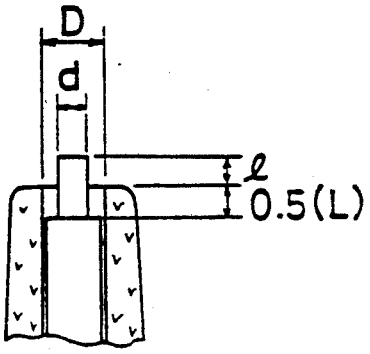
FIG. 26 is an explanatory view showing the dimensions of the spark plug used in conducting the experiments of FIGS. 20 to 25.

FIG. 26 shows the dimensions of a spark plug used in the experiments in FIGS. 20 to 25, in which the depth of the cylindrical space is L=0.5 mm.

According to FIG. 20, the effect of resistance to fouling increasing over 40 (cycles/1 MΩ) is not seen. Also according to FIG. 21, the effect of resistance to fouling increases over 40 (cycles/1 MΩ) only when the center electrode diameter is d=0.7 mm and the length l=0.2 mm.

Furthermore, according to FIG. 22, the effect of resistance to fouling grows over 40 (cycles/1 MΩ) when the center electrode diameter is 0.5 mm ≦d≦1.2 mm. Also the effect of resistance to fouling becomes greater than 40 (cycles/1 MΩ) when the length is 0.2 mm≦l≦1.1 mm. And in FIG. 22, all spark plugs of d≦0.7 mm and l≦1.1 mm indicate that the effect of resistance to fouling increases over 40 (cycles/1 MΩ).

According to FIG. 23, the effect of resistance to fouling exceeds 40 (cycles/1 MΩ) when the center electrode diameter is 0.60 mm≦d≦1.55 mm. Also the effect of resistance to fouling exceeds 40 (cycles/11 MΩ) when the center electrode length is 0.2 mm≦l≦1.1 mm. Furthermore, in FIG. 23, all spark plugs of l≦1.1 mm when d=1.1 mm exceed 40 (cycles/1 MΩ) in the effect of resistance to fouling.

According to FIG. 24, the effect of resistance to fouling exceeds 40 (cycles/1 MΩ) only when the center electrode diameter is d=1.5 mm and the center electrode length is l=0.2 mm. According to FIG. 25, none of the spark plugs exceeds 40 (cycles/1 MΩ) in the effect of resistance to fouling.

FIGS. 20 to 25 demonstrate that the desirable range of effect of resistance to fouling relative to the length of the center electrode is 0.2 mm≦l≦1.1 mm, and that the center electrode length l varies with the center electrode diameter d.

Furthermore, experiments were conducted on the effect of resistance to fouling relative to the center electrode length l, the center electrode diameter d, the inner diameter D of the inside bore, and the depth L of the cylindrical space.

Figure 27:
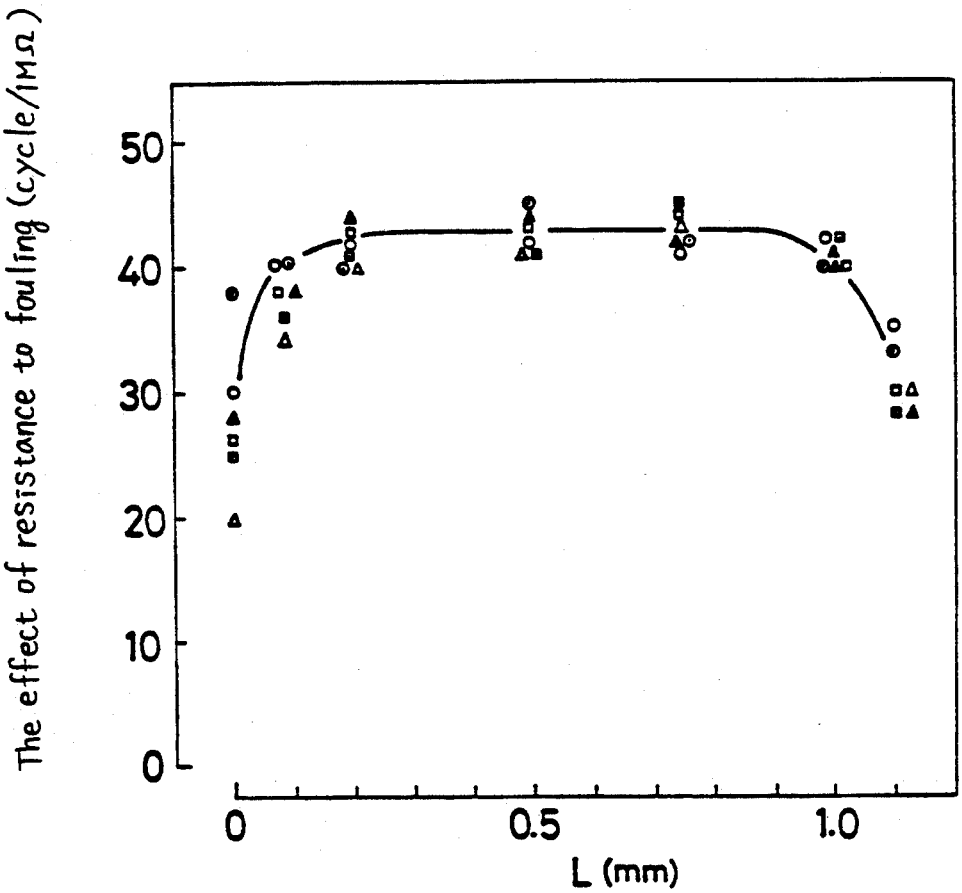
FIG. 27 is a graph showing a relation between the diameter d of the center electrode projecting out of the cylindrical space and the effect of resistance to fouling.

FIG. 27 indicates the depth L of the cylindrical space plotted on the horizontal axis and the effect of resistance to fouling plotted on the vertical axis. Also, in FIG. 27, o indicates the center electrode length l=0.2 mm; the center electrode diameter d=0.7 mm; and the inner diameter of the inside bore D=2.1 mm. indicates that the center electrode length l≦0.2 mm; the center electrode diameter is d=0.7 mm; and the inner diameter of the inside bore is D=1.1 mm. Δ denotes that the center electrode length is l=0.2 mm; the center electrode diameter is d=1.5 mm; and the inner diameter of the inside bore is D=2.8 mm. Δ indicates the center electrode length is l=0.2 mm; the center electrode diameter is d=1.5 mm; and inner diameter of the inside bore is D=2.0 mm. □ represents the center electrode length l=0.9 mm, the center electrode diameter d=0.7 mm, and the inner diameter of the inside bore D=1.5 mm. And □ indicates the center electrode length l=0.9 mm, the center electrode diameter d=1.5 mm, and the inner diameter of the inside bore D=2.4 mm.

According to FIG. 27, the effect of resistance to fouling exceeds 40 (cycles/1 MΩ) when the depth of the cylindrical space is 0.2 mm≦L≦1.0 mm. Within this range, nearly a constant effect of resistance to fouling is seen despite of changes in the center electrode length l, the center electrode diameter d, and the inner diameter D of the inside bore. Therefore, the spark plug disclosed in this invention should be free from the influence of the depth L of the cylindrical space relative to the effect of resistance to fouling. FIGS. 20 to 25, also show that the center electrode length l, the center electrode diameter d and the inner diameter D of the inside bore are correlated with one another.

Figure 28:
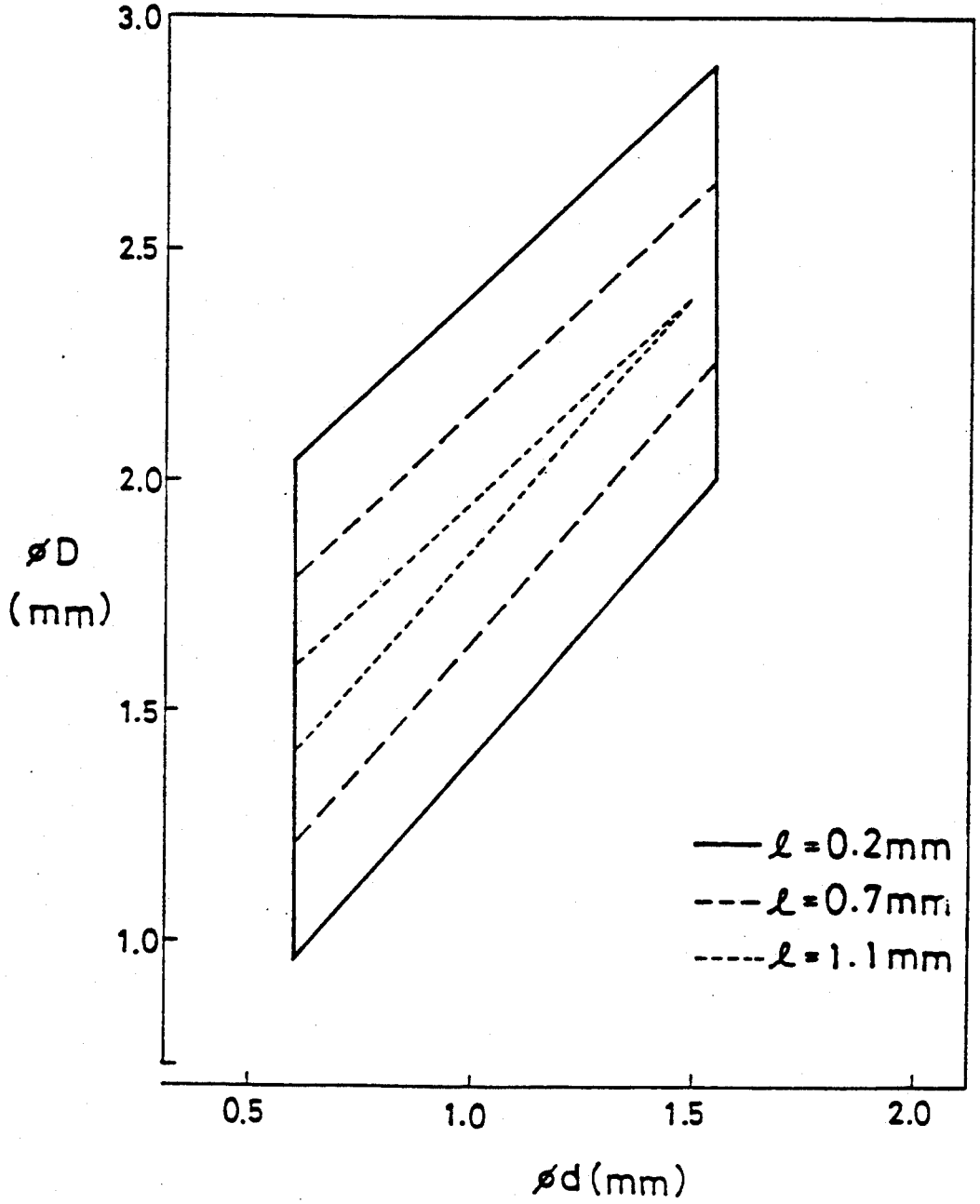
FIG. 28 is a graph showing a relation of the diameter d of the center electrode projecting out of the cylindrical space to the inner diameter D of the inside bore forming the cylindrical space between the inside bore and the center electrode when, for example, the length of the center electrode projecting out of the cylindrical space is l=0.2 mm, l=0.7 mm, and l=1.1 mm and the effect of resistance to fouling is over 40 cycles/MΩ.

FIG. 28 shows the center electrode diameter d plotted on the horizontal axis and the inner diameter D of the inside bore plotted on the vertical axis, giving one example of the range of the effect of resistance to fouling over 40 cycles when the center electrode length l=0.2 mm, l=0.7 mm, and l=1.1 mm.

FIG. 28 shows that the effect of resistance to fouling provided through the effective combination of the side discharge of the center electrode and ionization of the cylindrical space is within a desirable range relative to the combination of the center electrode length l, the center electrode diameter D of the inside bore.

It is understood from various experiments that the center electrode diameter of the present invention is between 0.60 mm≦d≦1.55 mm. Particularly when 0.8 mm≦d≦1.20 mm, the side discharge is generated at a high probability and the carbon burn-off length is prolonged, thereby improving the resistance to fouling. That is, the same result as that of the experiments in FIG. 12 to 14 could be obtained. In this result, d<0.60 mm and d>1.55 mm are not included in the desirable range probably because any effect to be obtained by the ionization range within the cylindrical space is not obtainable due to a low side discharge generation frequency and short carbon burn-off length.

As seen from the various experiments as well as FIGS. 16 and 17, desirable center electrode length is 0.2 mm ≦l≦1.1 mm. Furthermore, as is clear from FIG. 14, particularly when 0.2 mm≦l≦0.7 mm, the side discharge can be generated exactly from the cylindrical space, thereby enabling an improvement in the carbon burn-off effect.

Here, l<0.2 mm is not included within the desirable range for the following reason. As seen from the result of experiments shown in FIGS. 16 and 17, the spark voltage is high and the ignition performance is not within the desirable range, which have an effect on the life of the center electrode. Reversely, l>1.1 mm is not included in the desirable range because of a greater distance from the tip of the center electrode to the tip of the insulator nose and a lower effect of resistance to fouling by the side discharge than the result of experiments in FIGS. 20 to 25.

From various experiments it has been ascertained that the optimum range of the inner diameter of the inside bore satisfies D≧1.1 dmm+(l/2) mm+0.2 mm and D≦0.9 dmm−(l/2) mm+1.6 mm. Here, D<1.1 dmm+(l/2) mm+0.2 mm is not included within the desirable range because it is presumable that when the cylindrical space is narrower than the optimum size from which a cleaning effect can be expected, the heat energy of the induction discharge is restricted from expanding by the cooling action of the insulator and the center electrode, and therefore fails in effectively burning off carbon soot. Furthermore, the reason why D>0.9 dmm− (l/2) mm+1.6 mm is not included in the desirable range is that even when there exits a cylindrical space large enough to expect a cleaning effect, the inner diameter of the inside bore of the inside bore of the insulator is large, and accordingly a number of side discharges are required to burn off carbon deposit on the outer periphery, or the whole surface, of the insulator. From the result of experiments it is understood that when observation is made at the same discharge frequency, the part of the insulator to be cleaned will become relatively small if the insulator has a large inner diameter of the inside bore.

Figure 29:
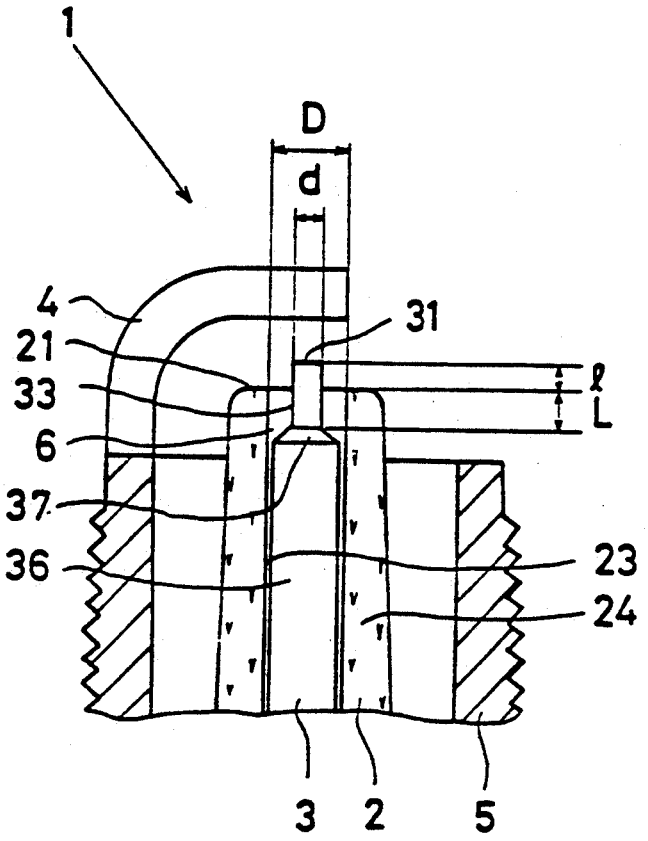
FIG. 29 is a sectional view showing a major portion of a spark plug for internal-combustion engines according to another embodiment invention.

FIG. 29 shows a variation of FIG. 1.

In this embodiment a taper section 37 is provided between the small-diameter portion 33 and the large-diameter portion 36 of the center electrode 3. This intermediate portion 38 has an diameter which is intermediate between the small-and large-diameter portions. In this example also, the side discharge is generated at the tip side surface of the small-diameter portion 33 similar to that shown in FIG. 1.

Figure 30:
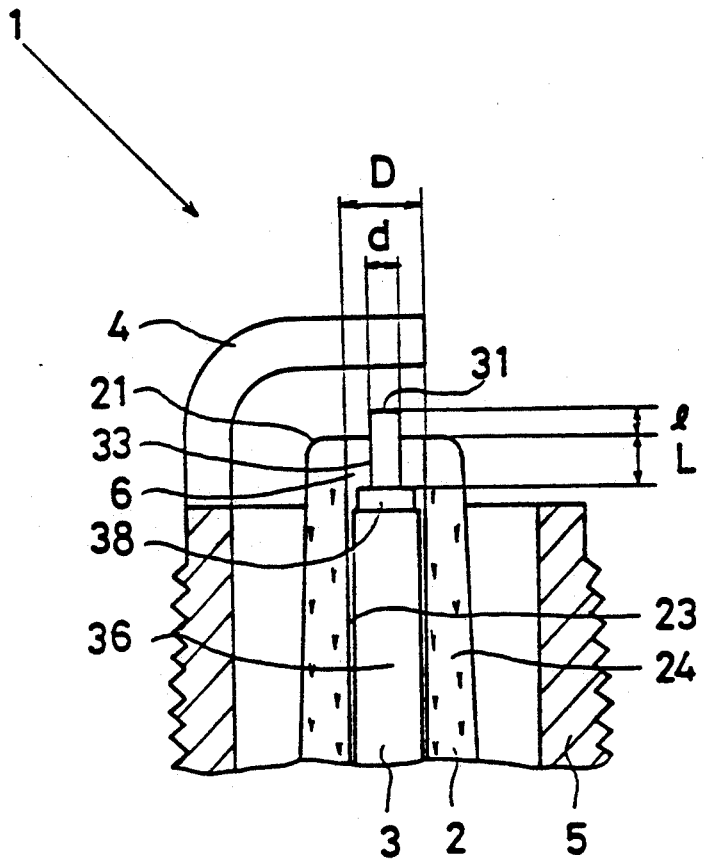
FIG. 30 is a sectional view showing a major portion of a spark plug for internal-combustion engines according to another embodiment of this invention.
Figure 31:
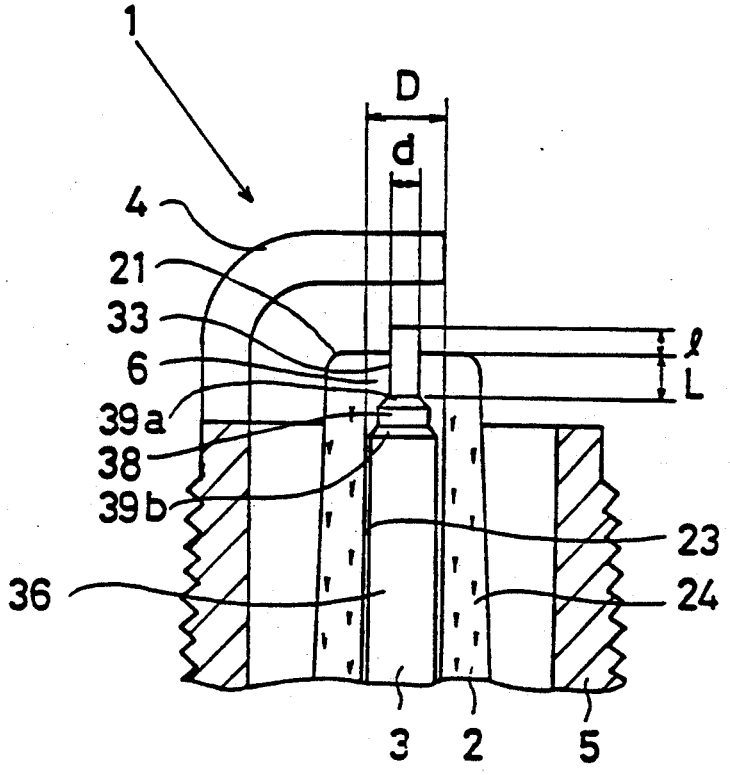
FIG. 31 is a sectional view showing major portion of a spark plug for internal-combustion engines according to another embodiment of-this invention.

FIG. 31 shows a variation of FIG. 30.

In this embodiment, a tapered section **39*a* is provided between the small-diameter portion 33 and the intermediate portion 38 of the center electrode 3, and further a tapered section 39*b* is provided between the intermediate portion 38 and the large-diameter portion 36. In this example also, the side discharge is generated from the tip side surface of the small-diameter portion similarly to that shown in FIG. 1**.

Figure 32:
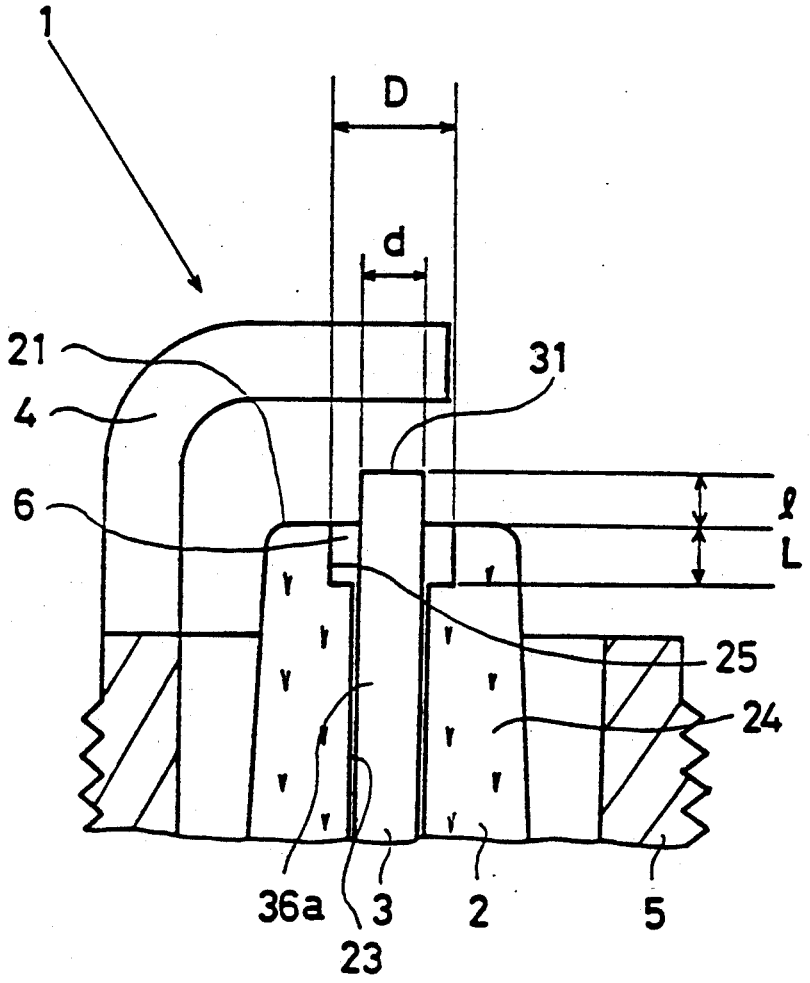
FIG. 32 is a sectional view showing a major portion of a spark plug for internal-combustion engines according to another embodiment of this invention.

FIG. 32 shows another variation of FIG. 1.

In this embodiment, d denotes the diameter of the center electrode 3 at the portion **36*a* held in the nose 24 of the insulator 2. This embodiment also includes a pocket 25, at the tip section of the insulator 2 forming the cylindrical space 6 between the outer periphery of the center electrode 3 and the wall surface of the inside bore 23. The side discharge is generated in the pocket 25 and at the tip side surface of the center electrode 3 which projects out of the pocket 25**.

Figure 33:
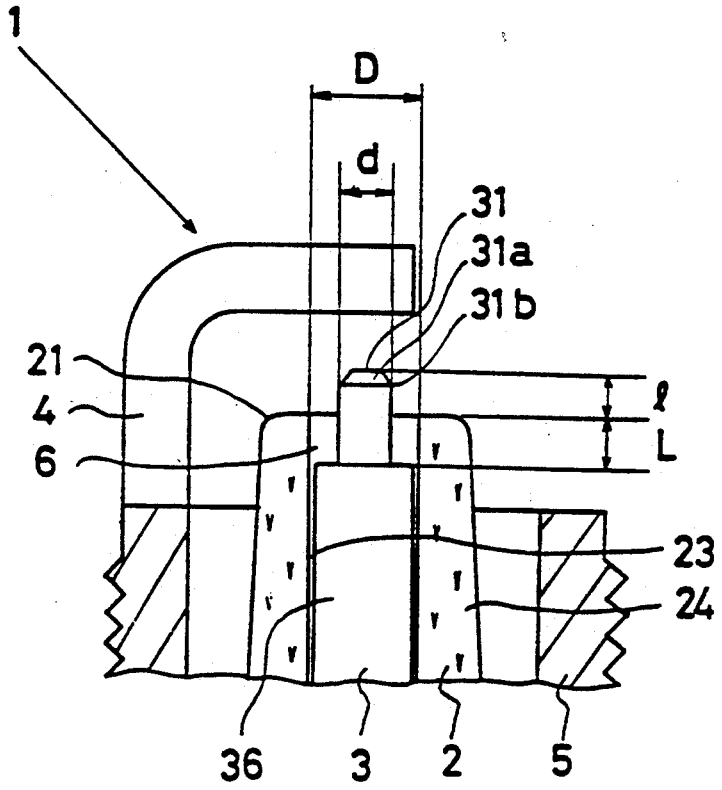
FIG. 33 is a sectional view showing a major portion of a spark plug for internal-combustion engines according to another embodiment of this invention.

FIG. 33 shows another embodiment, being another variation of FIG. 1.

In this embodiment, the tapered section **31*a* is provided at the end of the small-diameter portion 33 of the center electrode 3, Also, in this example, d represents the diameter of the large-diameter portion 31*b* which is of the largest diameter of the tapered section 31*a*. In this example also, the side discharge is generated from the tip side surface of the small-diameter 33 similarly to that in FIG. 1**.

According to this embodiment, the spark plug is provided with a resistor for the suppression of radio wave noise. However, it is not necessary required to provide the spark plug with this resistor for radio wave noise suppression.

The spark plug for internal-combustion engines of this invention has the following effect.

The use of a center electrode of decreased diameter can burn off carbon deposit on the tip of the insulator with the side discharge generated thereat. Furthermore, carbon deposit on the tip of the insulator nose and the wall surface of the inside bore can be burnt off by the combination of the ionization range produced by the pilot discharge in the cylindrical space and the side discharge, thereby remarkably improving the effect of resistance to fouling.

Furthermore, since the leakage frequency and time of high voltage applied to the center electrode leaking to the housing through the carbon soot markedly decrease, combustion misses and misfiring can be reduced considerably.

We claim:

1. A spark plug for an internal-combustion engine, comprising:

a cylindrical insulator having a central axis defining an axial direction and having an inner wall which defines an inside bore in said axial direction and having a nose portion at one end, a center electrode, located in said inside bore and held in said insulator, having a tip projecting out of said inside bore, a ground electrode spaced from said tip of said center electrode, and a housing, holding said ground electrode, and fixed on the outer periphery of said insulator, said cylindrical insulator including surfaces forming a cylindrical space opening at said nose portion of said insulator between an outer periphery of said center electrode and said inner wall of said inside bore, wherein said spark plug satisfies the following relations:

$$0.60 \text{ mm} \leqq d \leqq 1.55 \text{ mm}$$

where d represents a largest diameter of said center electrode which projects out of said inside bore.

2. A spark plug for an internal-combustion engine, comprising:

a cylindrical insulator having a central axis defining an axial direction and having an inner wall which defines an inside bore in said axial direction and having a nose portion at one end, a center electrode, located in said inside bore and held in said insulator, having a tip projecting out of said inside bore, a ground electrode spaced from said tip of said center electrode to form a gap between said ground electrode and said center electrode, and a housing, holding said ground electrode, and fixed on the outer periphery of said insulator, and a cylindrical space opening at said nose portion of said insulator between an outer periphery of said center electrode and said inner wall of said inside bore, wherein said spark plug satisfies the following relations:

$$0.60 \text{ mm} \leqq d \leqq 1.55 \text{ mm},$$

$$0.2 \text{ mm} \leqq l \leqq 1.1 \text{ mm},$$

$$D \geqq 1.1d \text{ mm} + (l/2)\text{mm} + 0.2 \text{ mm}$$

$$D \leqq 0.9d \text{ mm} - (l/2)\text{mm} + 1.6 \text{ mm}$$

where l denotes a length of said center electrode projecting out of said cylindrical space, d represents a diameter of said center electrode projecting out of said cylindrical space, and D is an inner diameter of said bore forming said cylindrical space between said inside bore and said center electrode.

3. A spark plug for an internal-combustion engine as claimed in claim 1, characterized in that said center electrode projecting out of said cylindrical space has a tapered portion at an end area thereof.

4. A spark plug for an internal-combustion engine as claimed in claim 1, characterized in that said diameter d is further limited to the range of:

$$0.8 \leqq d \leqq 1.2 \text{ mm}.$$

5. A spark plug for an internal-combustion engine as claimed in claim 1, characterized in that a length l of said center electrode projecting out of said cylindrical space is limited to the range of:

$$0.2 \leqq l \leqq 0.7 \text{ mm}.$$

6. A spark plug for an internal-combustion engine, comprising:

a cylindrical insulator having a central axis defining an axial direction and having an inner wall which defines an inside bore in said axial direction and having a nose portion at one end, a center electrode formed by a large-diameter portion, an intermediate portion, and a small-diameter portion;

said large-diameter portion located in said inside bore and held in said insulator, said small-diameter portion having a smaller diameter than said large-diameter portion and projecting out of said inside bore, said intermediate portion having an intermediate diameter between said small- and large-diameter portions and formed between and coupled to both of said small- and said large-diameter portions, a ground electrode spaced from said center electrode to form a gap, a cylindrical space opening at a nose of said insulator between an outer periphery of said small-diameter portion and the inner wall of said inside bore, wherein said spark plug satisfies the following relations:

$$0.60 \text{ mm} \leqq d \leqq 1.55 \text{ mm},$$

$$0.2 \text{ mm} \leqq l \leqq 1.1 \text{ mm},$$

$$D \geqq 1.1d \text{ mm} + (l/2)\text{mm} + 0.2 \text{ mm}$$

$$D \leqq 0.9d \text{ mm} - (l/2)\text{mm} + 1.6 \text{ mm}$$

where l denotes a length of said small-diameter portion of said center electrode projecting out of cylindrical space, d represents a diameter of said small-diameter portion of said center electrode projecting out of said cylindrical space, and D is an inner diameter of said bore forming said cylindrical space between said inside bore and said small-diameter portion of said center electrode.

7. A spark plug for an internal-combustion engine as claimed in claim 6, further comprising at least one tapered portion formed between at least one of a) said large-diameter portion and said intermediate portion or b) said intermediate portion and said small-diameter portion.

8. A spark plug for an internal-combustion engine as claimed in claim 6, further comprising a piece of noble metal, provided at least at one of said small-diameter portion of said center electrode and said ground electrode.

9. A spark plug for an internal-combustion engine, comprising:

an insulator having a central axis defining an axial direction and having an inner wall which defines an inside bore in said axial direction and having a nose portion at one end, a center electrode, located in said inside bore and held in said insulator, having a tip projecting out of aid inside bore, and said center electrode being of effective size to cause sufficient side discharge to burn off carbon deposits on a least said nose portion of said insulator, a ground electrode facing and spaced from said tip of said center electrode to form a gap between said ground electrode and said center electrode, in a way to allow capacity discharge between said ground electrode and said tip of said center electrode, a housing, holding said ground electrode, and fixed on an outer surface of said insulator, said insulator including surfaces forming a space opening at said nose of said insulator between an outer portion of said center electrode and said inner wall of said inside bore.

10. A spark plug for an internal-combustion engine as claimed in claim 9, characterized in that a diameter of said center electrode d is between 0.60 mm and 1.55 mm.

11. A spark plug for an internal-combustion engine as claimed in claim 9, characterized in that a frequency of occurrence of said side discharge is at least 50%.

12. A method of providing and operating a spark plug for an internal-combustion engine, comprising the steps of:

providing a spark plug which has a) a cylindrical insulator having a central axis defining an axial direction and having an inner wall which defines an inside bore in said axial direction and having a nose portion at one end, b) a center electrode, located in said inside bore and held in said insulator, having a tip projecting out of said inside bore, and said center electrode being of an effective size to cause sufficient side discharge to allow burning off carbon deposits on at least said nose portion of said insulator, c) a ground electrode spaced from said tip of said center electrode to form a gap between said ground electrode and said center electrode, and d) a housing, holding said ground electrode, and fixed on an outer surface of said insulator, wherein said cylindrical insulator includes a space opening at said nose portion of said insulator between an outer surface of said center electrode and said inner wall of said inside bore;

operating said spark plug and forming a high-resistance conductive layer of fouling on said nose portion of said cylindrical insulator, producing a pilot discharge between said cylindrical insulator and an inner wall of said center electrode, forming an ionization within a range adjacent said pilot discharge, producing a capacity discharge at an edge portion of said center electrode, and producing a side discharge at said range of said ionization at least 50% of the time, and burning off said high-resistance conductive layer in said range.

13. A spark plug for an internal-combustion engine, as in claim 2, wherein said diameter d represents a largest diameter of said center electrode projecting out of said cylindrical space.

14. A spark plug for an internal-combustion engine, as in claim 6, wherein said diameter d represents a largest diameter of said small-diameter portion of said center electrode projecting out of said cylindrical space.

* * * * *